United States Patent [19]

Greer et al.

[11] Patent Number: 4,634,618

[45] Date of Patent: Jan. 6, 1987

[54] WEIGHTED TOWEL

[76] Inventors: Keith B. Greer; O'Neil J. Greer, both of 3195 Foxcroft Rd., #F203, Miramar, Fla. 33025

[21] Appl. No.: 746,506

[22] Filed: Jun. 19, 1985

[51] Int. Cl.[4] ..... B32B 3/08

[52] U.S. Cl. ..... 428/81; 428/100; 428/126; 428/193; 428/82; 52/3; 5/417

[58] Field of Search ..... 428/81, 82, 99, 193, 428/126, 100; 52/3; 5/417, 419, 420; 47/28 R

[56] References Cited

U.S. PATENT DOCUMENTS

| | | | |
|---|---|---|---|
| D. 258,035 | 1/1981 | Fenwick . | |
| 1,034,667 | 8/1912 | Winter . | |
| 1,581,970 | 4/1926 | McCollum | 428/82 |
| 1,951,527 | 3/1934 | Oas | 5/417 X |
| 2,344,010 | 3/1944 | Walsh . | |
| 3,237,904 | 3/1963 | Abruzese | 248/361 |
| 3,862,876 | 1/1975 | Graves | 428/193 |
| 4,272,575 | 6/1981 | Egigian | 428/83 |

*Primary Examiner*—Alexander S. Thomas
*Attorney, Agent, or Firm*—Oltman and Flynn

[57] ABSTRACT

This invention improves the ordinary beach towel or picnic blanket by providing a means to hold it secure in the wind. A hidden weighted cord sewn into the perimeter holds the material in place. The device may have an optional attached carry bag. The invention is safe and washable and easily carried.

3 Claims, 6 Drawing Figures

FIG. 1
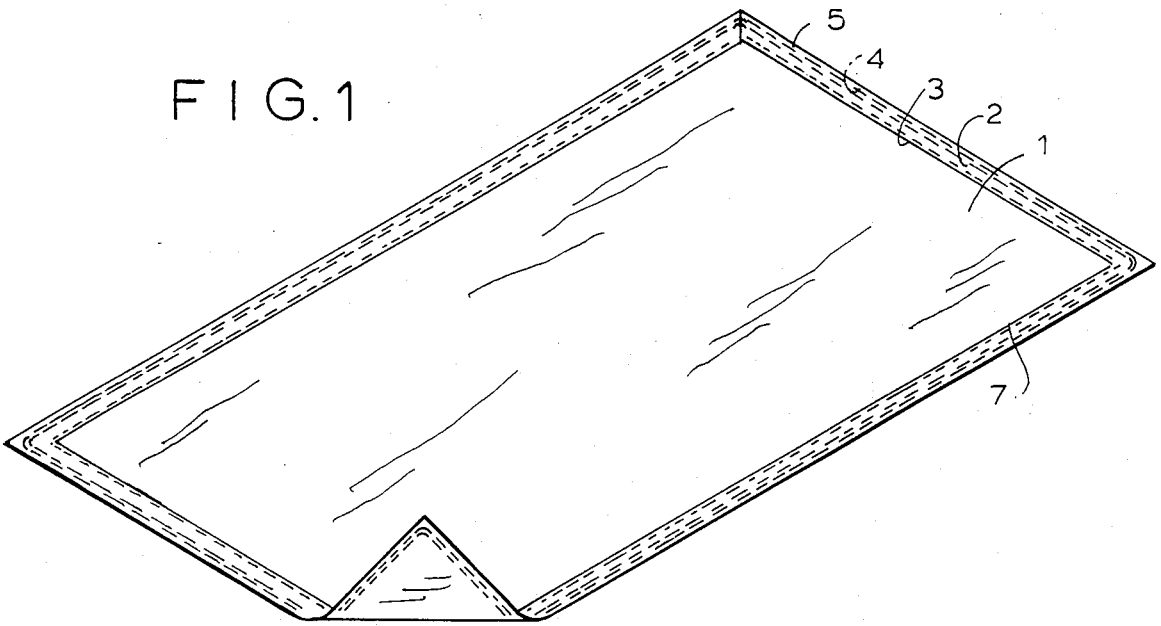
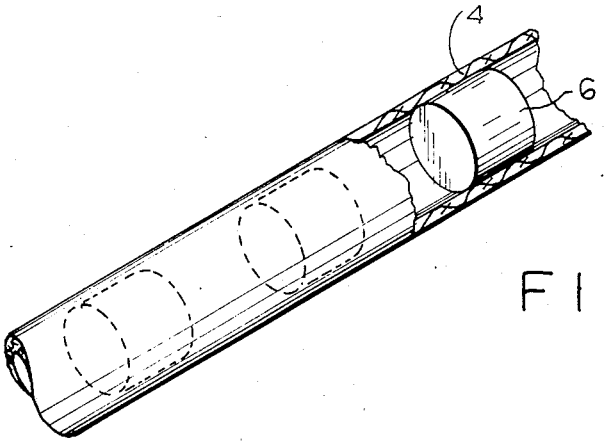
FIG. 2
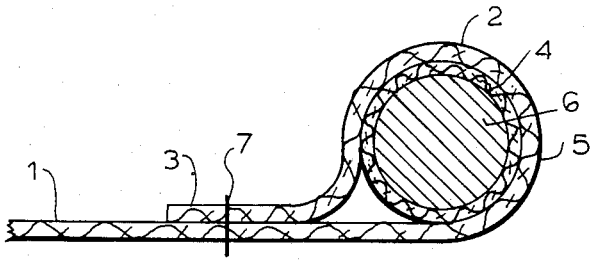
FIG. 3

FIG. 4
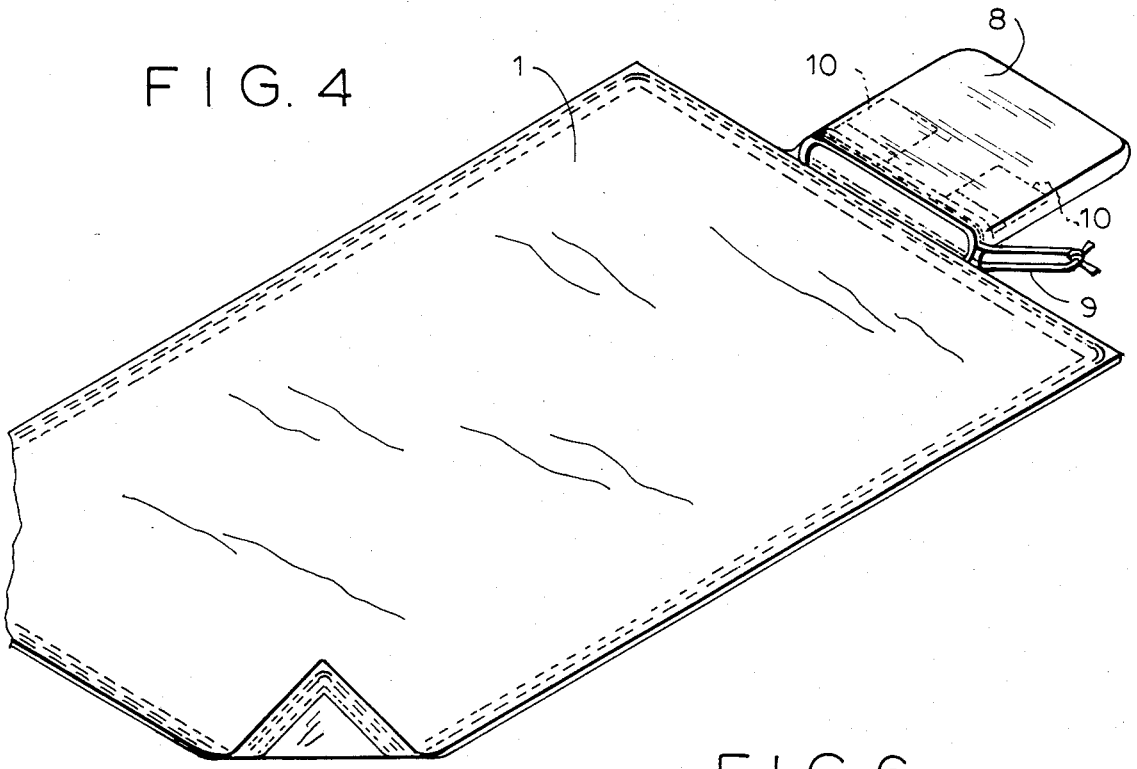
FIG. 6
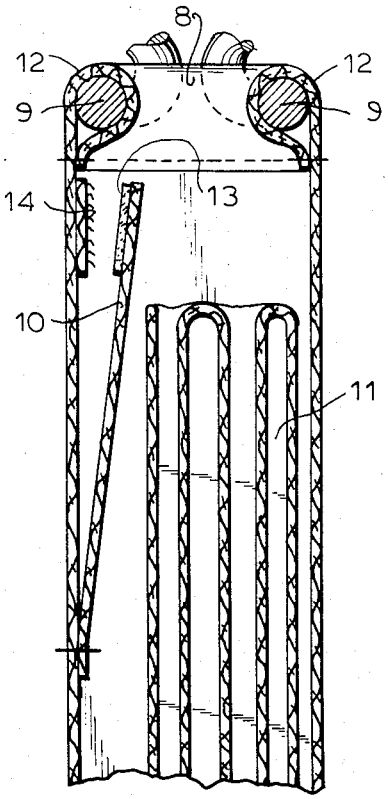
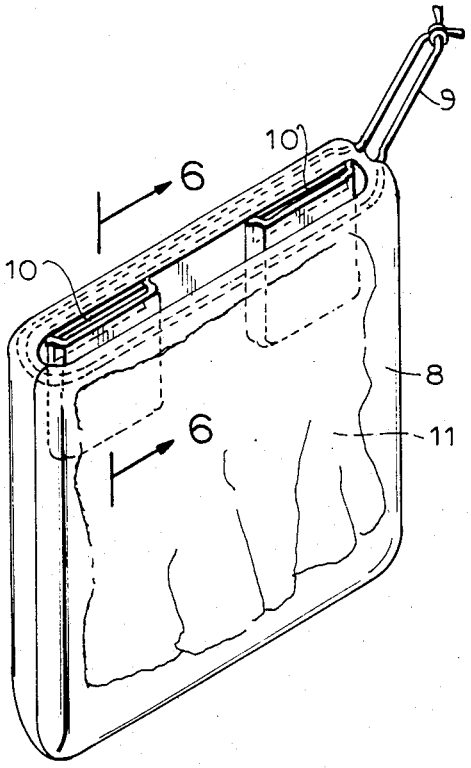
FIG. 5

WEIGHTED TOWEL

BACKGROUND OF THE INVENTION

The present invention relates to a convenient means to prevent a beach towel or blanket from blowing away. The primary object sought is to hold a towel, blanket or material flat on the ground during moderate winds. Swimmers and sunbathers enjoy returning to a flat beach towel or blanket. If the wind has blown their towel around, then it will be sandy. Historically people have stacked picnic baskets or other articles on their beach towel or blanket while not using it. U.S. Pat. No. 3,237,904 to Albruzese disclosed spikes to push into the sand and secure to the corners of a towel. The present invention has no dangerous parts and is fully washable.

SUMMARY OF THE INVENTION

The primary object of the present invention is to provide a simple and safe means to secure a beach towel or blanket to the ground in the wind. A second object is to make the invention easily carried. One embodiment offers an attached bag for holding wallet, clothing, etc. while swimming. These objects and others will become apparent from the drawings, the description given herein and the appended claims.

In all embodiments the anchoring means is provided by a weighted cord sewn all around the perimeter of the material. Thus this invention could comprise a beach towel or a blanket or a mat. Metal weights are first inserted into a woven cord. The ends are sealed. Such weighted cords are available commercially. The weighted cord is then sewn into a hem along the perimeter of the material.

A second embodiment adds a carry bag to one end of the material. Two small Velcro® fastened pockets inside the bag provide storage for small items like watches. The bag is closed shut with a drawstring.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 1 is a top view of a beach towel.

FIG. 2 shows the weights inside the cord.

FIG. 3 is a cross-sectional view of the edge of the towel showing the weighted cord sewn into the perimeter.

FIG. 4 is a top view of a beach towel with the carry bag.

FIG. 5 shows the optional carry bag with drawstring and inside pockets.

FIG. 6 is a cross-sectional view of the carry bag showing the drawstring and Velcro® pocket fasteners.

DESCRIPTION OF THE PREFERRED EMBODIMENTS

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Referring first to FIG. 1, the towel 1 comprises a hem 2 all around the perimeter 5. The hem 2 covers the weighted cord 4. The hem 2 is stitched along seam 3 thus holding cord 4 in place along the perimeter 5 of the towel. This weighting of the edges of the towel (or blanket, mat or similar material) holds the towel down in moderate winds.

FIG. 2 shows the cord 4 having weights 6 inside. The weights 6 fit snugly against the inside of cord 4 so as not to slip to one end of the towel 1 (see FIG. 1).

FIG. 3 shows a cross section of the perimeter 5 of towel 1. Hem 2 covers cord 4 which includes weights 6. Seam 3 is held in place by stitches 7.

FIG. 4 shows towel 1 comprising a carry bag 8 affixed to one end. Drawstring 9 closes the carry bag. Inside pockets 10 are shown at the top of carry bag 8.

FIG. 5 shows a carry bag 8 with a closing means comprised of a drawstring 9. Two inside pockets 10 are designed to hold small valuables. A folded towel 11 is shown (dotted lines) inside the carry bag 8.

FIG. 6 shows one inside pocket 10 inside carry bag 8. Carry bag 8 is closed by means of drawstring 9 sliding in hem 12. Inside pocket 10 is closed by means of Velcro® locking portion 13 and piles 14. When towel 1 is in use for sunbathing the carry bag 8 could be folded back against itself for use as a pillow.

We claim:

1. A flat material suitable for use as a beach towel, outdoor blanket or mat, said material having a weighted cord affixed along substantially all the perimeter thereof; and a carry bag affixed at one end thereof.

2. The flat material of claim 1 further comprising a closing means consisting of a drawstring secured to a mouth of said carry bag.

3. The flat material of claim 1 further comprising two inside pockets having fastening material consisting of a hooking portion and a pile portion sewn to the inside of said carry bag.

* * * * *